United States Patent [19]

Rohr

[11] Patent Number: 5,072,991

[45] Date of Patent: Dec. 17, 1991

[54] FLOATING GRAB DREDGE AND UNLOADING METHOD THEREFOR

[76] Inventor: Jochen Rohr, 6669 Spindlewick La., Cincinnati, Ohio 45230

[21] Appl. No.: 571,778

[22] Filed: Aug. 24, 1990

[51] Int. Cl.[5] ..... F02F 3/413; F02F 7/06

[52] U.S. Cl. ..... 299/9; 37/71; 37/195; 209/261; 414/142.9

[58] Field of Search ..... 299/9; 37/54, 57, 71, 37/195; 209/261, 352, 420, 421, 675; 414/142.9, 143.1, 137.9, 138.6; 114/61

[56] References Cited

U.S. PATENT DOCUMENTS

| | | | |
|---|---|---|---|
| 3,704,796 | 12/1972 | Dedons et al. | 414/138.6 |
| 4,216,997 | 8/1980 | Fiebig | 37/71 X |
| 4,265,036 | 5/1981 | Staats | 37/71 |

FOREIGN PATENT DOCUMENTS

| | | | |
|---|---|---|---|
| 2262920 | 6/1974 | Fed. Rep. of Germany | 37/195 |
| 37426 | 2/1987 | Japan | 37/57 |

*Primary Examiner*—David J. Bagnell
*Attorney, Agent, or Firm*—Kinzer, Plyer, Dorn, McEachran & Jambor

[57] ABSTRACT

A floating grab dredge has first and second pontoons spaced apart sufficiently to define a work space therebetween. The work space is large enough to define a barge slip therein as well as a digging well adjacent to the barge slip. A gantry mounted on the pontoons by supports spans the work space. Material handling apparatus on one of the pontoons includes a grizzly for separating waste from recoverable material. The gantry includes tracks on which a trolley shuttles among positions above the digging well, barge slip and grizzly. When a load of dredged material is brought up from the digging well it is inspected to determine if it contains recoverable material. If it does the trolley is moved above the grizzly and the load is dumped on the grizzly. If no recoverable material is in the load, it is dumped into a barge in the barge slip and digging continues.

8 Claims, 3 Drawing Sheets

FLOATING GRAB DREDGE AND UNLOADING METHOD THEREFOR

BACKGROUND OF THE INVENTION

This invention relates to floating dredges of the type having pontoons mounting a superstructure including supports for a gantry. A trolley rides on tracks on the gantry to position a bucket grab connected to the trolley. The bucket grab removes sand, clay, gravel or the like from the bottom of a waterway. A material handling apparatus is provided on the pontoons to receive and process the dredged material.

The dredged material sometimes will contain components whose value justifies recovering them. Sand and gravel are examples. Other components such as clay are not desirable for recovery and are simply collected for removal. Separating the recoverable material from the unrecoverable, however, slows down the dredging process. This is because in the past all dredged material has had to be processed through the material handling apparatus even when it contained nothing of value.

SUMMARY OF THE INVENTION

The present invention concerns a dredge of the type described and a method of operating it that significantly increases productivity by providing alternate grab emptying sites for dredged material, the emptying site selected depending on whether there is recoverable material in a particular load.

The dredge of the present invention is configured with first and second pontoons spaced apart sufficiently to define a work space between them. The work space is large enough to include the usual digging well, i.e., that area in which the bucket grab is lowered to remove material from the bottom of the waterway. The work space also has room for a refuse barge to be placed therein. This space will be referred to as a barge slip. The barge slip is adjacent the digging well.

Supports are constructed on the pontoons to uphold a gantry or crane that spans the work space. The gantry includes tracks on which a trolley can move back and forth. The trolley suspends a bucket grab. The gantry and/or trolley carry the necessary equipment for operating the grab, such as lines, pulleys, motors, counterweights and the like.

One of the pontoons has material handling apparatus for separating the recoverable components of a load from the undesired portions of the same load. This apparatus includes, among other things, a grizzly supported above a hopper which directs recovered material to a conveyor. The conveyor may be used to carry recovered material to a remote recovery station. Refuse retained on the top of the grizzly is removed by a rake to a chute. The chute is directed to a refuse barge which may be the one in the barge slip or a separate, second barge located outside the pontoons.

When a new load of dredged material breaks the water's surface, it is inspected for the presence of recoverable components. If there are none, the material is quickly and simply dumped into the refuse barge. If recoverable material is found in the load, the trolley is positioned over the grizzly and the load is dumped onto the grizzly. Since the refuse barge can be immediately adjacent the digging well, dumping of refuse loads there is faster than moving the grab to the higher and farther away grizzly. This affords a faster method of dredging. The advantage of the present invention is particularly evident in the common situation where nothing but unusable material is being found in load after load.

Another advantage of the present invention is the refuse barge affords a storage location for a spare bucket grab. Sometimes conditions favor a grab of a different type than the one installed on the trolley. Or a grab may be damaged or otherwise in need of repair. Dredges of known construction have no place to put a spare grab should it become necessary or desirable to change grabs. Prior art dredges must then leave the work site and return to a service location for grab changeout. With the dredge of the present invention grab changeout can be performed at the work site by placing a spare grab in the refuse barge. Then the trolley is simply placed over the refuse barge for switching grabs.

DETAILED DESCRIPTION OF THE INVENTION

Figure 1:
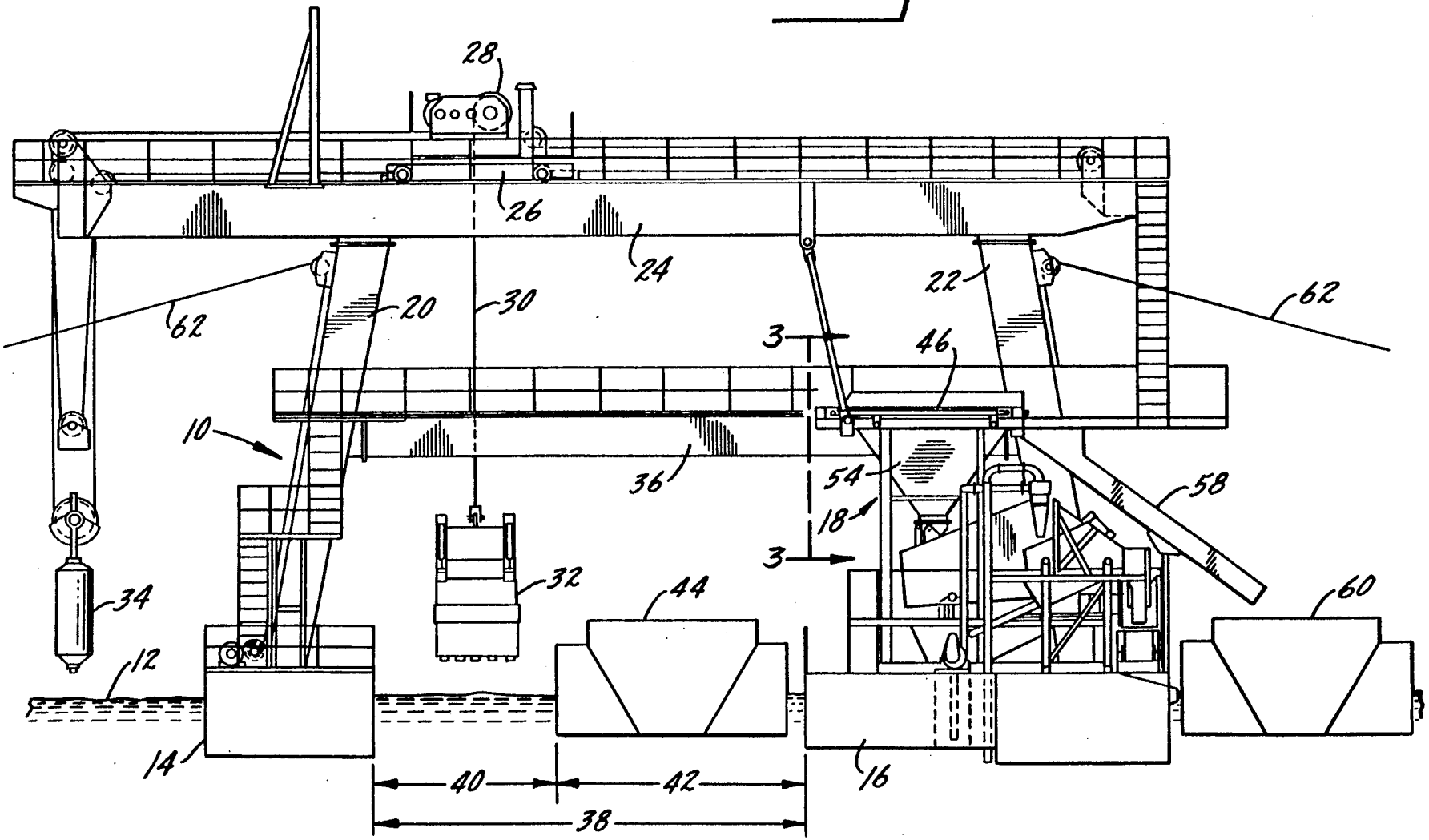
FIG. 1 is an elevation view of the dredge, looking in a direction parallel to the pontoons.
Figure 2:
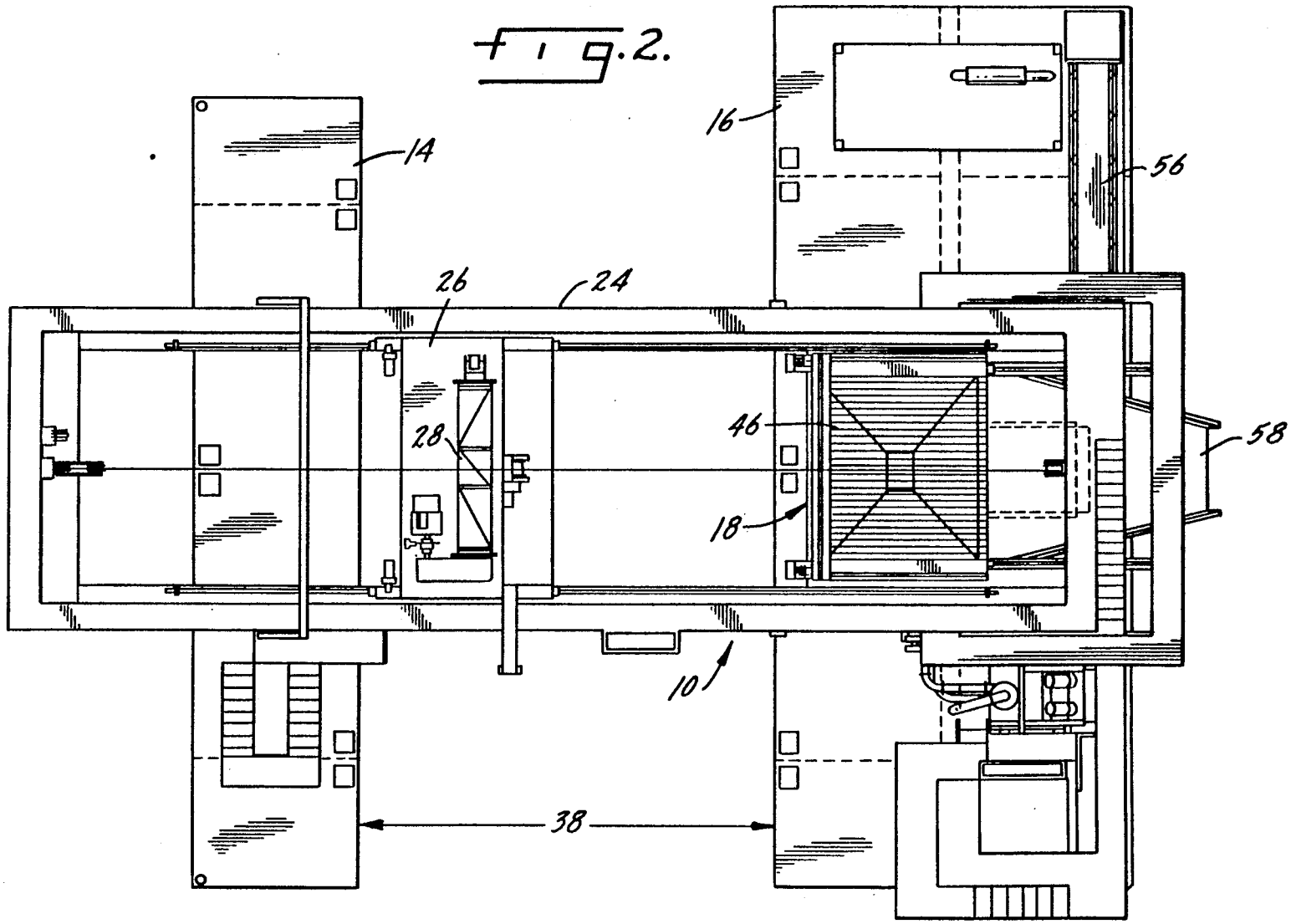
FIG. 2 is a plan view of the dredge.

The floating dredge of the present invention is shown generally at 10 in FIGS. 1 and 2 floating in a waterway whose water line is shown at 12. The dredge comprises first and second pontoons 14 and 16. While the term pontoon is used herein, it will be understood that the term is intended to include any suitable floating structure. The second pontoon 16 has a material handling apparatus 18 installed on it. Details of this apparatus will be explained below.

A support structure is mounted on the pontoons. It includes a set of uprights 20 and 22 (FIG. 1). The uprights support a gantry 24. The gantry has tracks on which a trolley 26 moves back and forth. The trolley carries a winch 28 which controls a set of lines, one of which is seen at 30. These lines 30 are connected to a bucket grab 32 for raising and lowering it. A counterweight 34 is connected to the end of the gantry by suitable lines and pulleys to assist operation of the grab. The support structure may also include a catwalk 36 and the usual ladders and railings for the convenience and safety of operating personnel.

As shown in FIGS. 1 and 2, the pontoons 14 and 16 are spaced apart to define a work space 38 between them. The separation of the pontoons is great enough to define a work space 38 that can accommodate a refuse barge and a digging well. Thus, the work space 38 can be subdivided into a digging well 40 and a barge slip 42 (FIG. 1). These areas are adjacent one another. They are large enough to accommodate a refuse barge 44 and the bucket grab 32.

Figure 3:
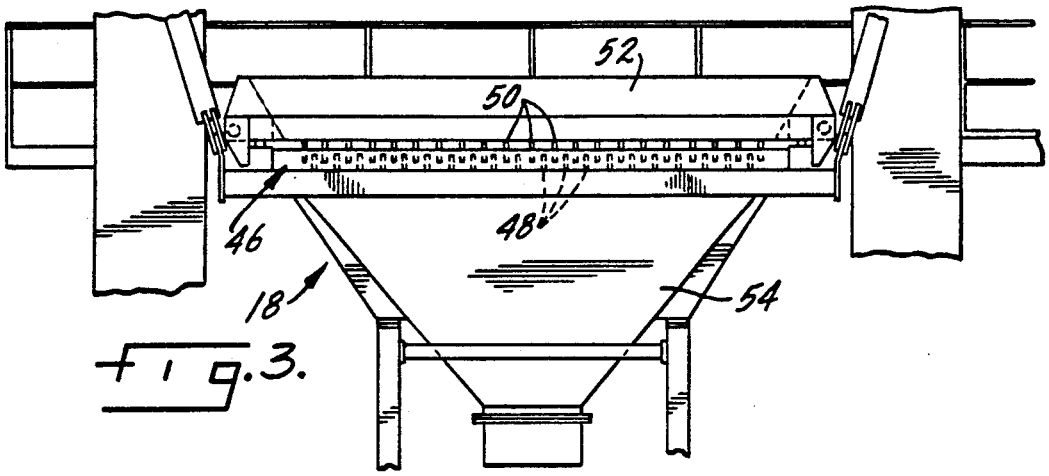
FIG. 3 is an elevation view of the grizzly, looking in the direction of line 3—3 of FIG. 1.
Figure 4:
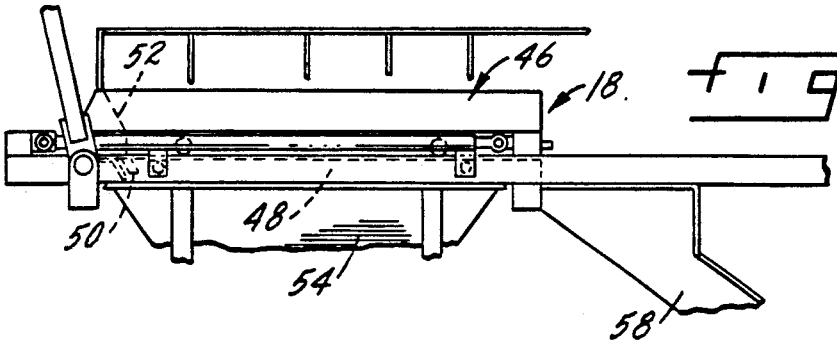
FIG. 4 is a side elevation view of the grizzly.
Figure 5:
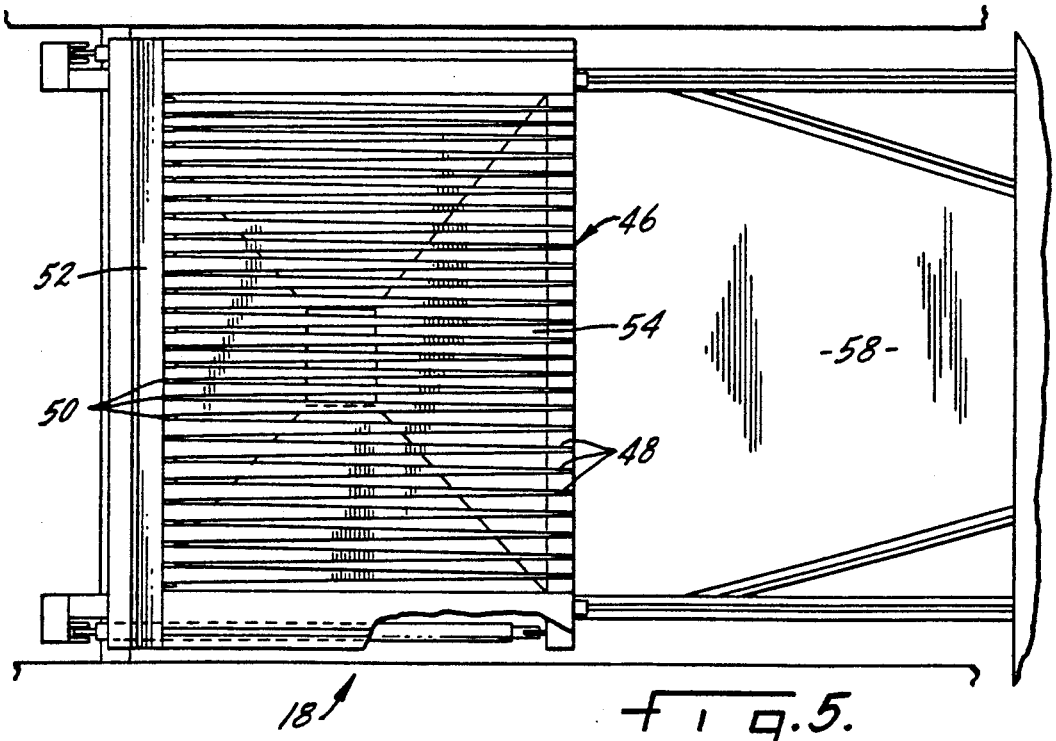
FIG. 5 is a plan view of the grizzly.

Turning now to the material handling apparatus 18, details of this apparatus are shown in FIGS. 3-5. The material handling apparatus includes a grizzly 46. The grizzly comprises a grid of generally parallel bars 48, each having an elongated triangular shape. The bars define gaps therebetween. The fingers 50 of a rake are disposed in these gaps. The fingers extend from a base member 52.

Beneath the grizzly is a hopper 54. The grizzly acts as a screen, filtering out large material and preventing it from falling into the hopper 54. Material that does make into the hopper is processed in a conventional manner and supplied to a take-away conveyor 56, shown in FIG. 2. Large pieces of material that are caught by the grizzly are removed by a sideways movement of the rake. The rake pushes refuse off of the grizzly onto a discharge chute 58. From there refuse falls into a second refuse barge 60 (FIG. 1) which is tied alongside the second pontoon 16.

The use, operation and function of the floating dredge are as follows. The dredge 10 is first positioned at the desired location and anchored by lines 62 (FIG. 1). A first refuse barge 44 is placed in the barge slip 42 and secured to the dredge. A second refuse barge 60 is tied alongside the outside of pontoon 16. It will be understood that reversing the direction of chute 58 toward the barge slip 42, only a single refuse barge could be used.

Once all the floating components are in place and secured, digging can begin. The trolley 26 is moved to a position above the digging well 40 and the winch 28 is operated to lower the bucket grab 32 to the floor of the waterway. When the grab has procured a load of material, it is raised above the surface of the water. Then the operator makes a visual inspection of the material in the grab to determine if it contains material worth salvaging.

If there is recoverable material in the grab, the trolley is moved to a position above the grizzly 46 and the grab is emptied onto the grizzly. Desirable material such as sand and small gravel will fall through the grizzly into the hopper 54. From there the usual material handling apparatus will transfer the recovered material to the conveyor 56. If the load also contained large pieces of material, these will remain on the top of the grizzly. They are periodically removed therefrom by operating the rake. The rake fingers 50 move from one edge of the grizzly to the other, pushing any waste material onto the chute 58. From there the waste slides into refuse barge 60.

If there is no recoverable material in the grab, the trolley is moved to a position above the first refuse barge 44 and the grab is emptied into that barge. The bucket grab is then moved back to the well and digging resumes. Since the barge 44 is immediately adjacent the digging well and the barge sits relatively low compared to the grizzly, a full load of waste material can be emptied quickly, allowing the grab to return for the next load more rapidly than if each load were lifted and transported to the grizzly.

Whereas as preferred form of the invention has been shown and described, it will be realized that alterations could be made thereto without departing from the scope of the following claims. For example, the locations of the digging well 40 and barge slip 42 could be reversed. This arrangement would place the digging well between the two alternate emptying sites, minimizing the time for moving the grab to an emptying site in the situation where the loads are variable in their content of recoverable material.

I claim:

1. A floating dredge, comprising:

first and second pontoons spaced apart to define a work space between them, the work space being large enough to define a barge slip therein and a digging well adjacent the barge slip, the barge slip being adjacent one pontoon and the digging well being adjacent the other pontoon;

a support structure mounted on the pontoons;

a gantry attached to the support structure and spanning both the barge slip and digging well of the work space;

a trolley movably mounted on the gantry;

a bucket grab connected to the trolley and movable therewith such that the grab can be maneuvered between the digging well and barge slip.

2. The dredge of claim 1 further comprising material handling means mounted on one of the pontoons for separating salvageable dredged material from waste.

3. The dredge of claim 2 wherein the material handling means includes a grizzly mounted on the support structure and a hopper mounted below the grizzly for recovering material falling through the grizzly, the gantry spanning the grizzly such that the trolley and bucket grab being movable to a position above the grizzly.

4. The dredge of claim 3 further comprising a chute mounted adjacent the grizzly for receiving refuse from the top of the grizzly.

5. The dredge of claim 4 wherein the chute is directed to a point outside the pontoons.

6. The dredge of claim 1 wherein the pontoons define longitudinal axes which are parallel to one another and the gantry has a longitudinal axis which is perpendicular to the axes of the pontoons.

7. A method of operating a floating dredge of the type having first and second pontoons, a support structure mounted on the pontoons, a gantry attached to the support structure, a trolley movably mounted on the gantry, a bucket grab connected to the trolley and movable therewith, and material handling means mounted on one of the pontoons for separating salvageable dredged material from waste, comprising the steps of:

spacing the first and second pontoons sufficiently far apart to define a work space between them, the work space defining a barge slip therein and a digging well adjacent the barge slip;

placing a first barge in the barge slip;

moving the trolley over the digging well and operating the bucket grab to dig up a load of dredged material;

inspecting the dredged material in the grab to determine if it contains salvageable material;

moving the trolley over the first barge if there is no salvageable material in the bucket load and moving the trolley over the material handling means if there is salvageable material; and dumping the load at the selected location.

8. The method of claim 7 further comprising the step of placing a second barge adjacent the material handling means such that it is in position to receive waste material therefrom.

* * * * *